US011578556B2

(12) United States Patent
Carragher

(10) Patent No.: US 11,578,556 B2
(45) Date of Patent: Feb. 14, 2023

(54) WELL CASING/TUBING DISPOSAL

(71) Applicant: BISN TEC LTD., Runcorn (GB)

(72) Inventor: Paul Carragher, Lymm (GB)

(73) Assignee: Bisn Tec Ltd., Warrington (GB)

( * ) Notice: Subject to any disclaimer, the term of this patent is extended or adjusted under 35 U.S.C. 154(b) by 453 days.

(21) Appl. No.: 15/300,867

(22) PCT Filed: Apr. 2, 2015

(86) PCT No.: PCT/GB2015/051045

§ 371 (c)(1),
(2) Date: Sep. 30, 2016

(87) PCT Pub. No.: WO2015/150828

PCT Pub. Date: Oct. 8, 2015

(65) Prior Publication Data

US 2017/0030162 A1 Feb. 2, 2017

(30) Foreign Application Priority Data

Apr. 4, 2014 (GB) ..... 1406071

(51) Int. Cl.
*E21B 29/02* (2006.01)
*E21B 29/10* (2006.01)
(Continued)

(52) U.S. Cl.
CPC ..... *E21B 33/138* (2013.01); *E21B 29/02* (2013.01); *E21B 29/10* (2013.01); *E21B 36/001* (2013.01);
(Continued)

(58) Field of Classification Search
CPC ..... E21B 29/02; E21B 29/10
(Continued)

(56) References Cited

U.S. PATENT DOCUMENTS 1,534,229 A 4/1925 Livergood
2,076,308 A 4/1937 Wells
(Continued)

FOREIGN PATENT DOCUMENTS

CA 2592556 6/2007
EP 1 933 004 6/2008
(Continued)

OTHER PUBLICATIONS

The Dow Chemical Company, "Downtherm—A Heat Transfer Fluid," Mar. 1997, pp. 2-31. (Year: 1997).*
(Continued)

*Primary Examiner* — William D Hutton, Jr.
*Assistant Examiner* — Ashish K Varma

(57) ABSTRACT

A method of clearing well casing (3) or tubing from a target region of an oil/gas well (1) borehole is provided. The clearance of the oil/gas well bore hole being achieved by employing chemical agents (9) that consume, weaken or melt the well casing/tubing. In some aspects of the method the well casing is cleared to expose the rock formation within which the well borehole is formed so that the rock formation can be accessed from within the well casing/tubing. In other aspects of the method the removal of inner tubing structures is used to facilitate the unimpaired deployment of repair tools down the well borehole.

17 Claims, 1 Drawing Sheet

(51) Int. Cl.
*E21B 33/138* (2006.01)
*E21B 36/00* (2006.01)
*E21B 37/00* (2006.01)
*E21B 33/16* (2006.01)

(52) U.S. Cl.
CPC ..... *E21B 36/003* (2013.01); *E21B 36/008* (2013.01); *E21B 37/00* (2013.01); *E21B 33/16* (2013.01)

(58) Field of Classification Search
USPC ..... 166/277
See application file for complete search history.

(56) References Cited

U.S. PATENT DOCUMENTS

| | | | | |
|---|---|---|---|---|
| 2,686,689 | A | 8/1954 | Douglas | |
| 2,789,004 | A | 4/1957 | Forster | |
| 2,822,876 | A | 2/1958 | Murrow | |
| 2,935,020 | A * | 5/1960 | Howard | E21B 29/02 102/307 |
| 3,119,451 | A | 1/1964 | Hall | |
| 3,170,516 | A | 2/1965 | Corley | |
| 3,208,530 | A | 9/1965 | Allen | |
| 3,565,177 | A * | 2/1971 | Hutchison | E21B 37/00 166/301 |
| 3,871,315 | A | 3/1975 | Anderson | |
| 4,134,452 | A | 1/1979 | Kingelin | |
| 4,220,487 | A | 9/1980 | Anderson | |
| 4,423,783 | A | 1/1984 | Haag | |
| 4,488,747 | A | 12/1984 | Austin | |
| 4,523,640 | A | 6/1985 | Wilson | |
| 4,696,343 | A | 9/1987 | Anderson | |
| 4,890,675 | A * | 1/1990 | Dew | E21B 7/046 166/376 |
| 5,052,489 | A | 10/1991 | Carisella | |
| 5,564,861 | A | 10/1996 | Khudenko | |
| 6,102,120 | A | 8/2000 | Chen | |
| 6,454,001 | B1 | 9/2002 | Thompson | |
| 6,474,414 | B1 | 11/2002 | Gonzalez | |
| 6,664,522 | B2 | 12/2003 | Spencer | |
| 6,828,531 | B2 | 12/2004 | Spencer | |
| 6,923,263 | B2 | 8/2005 | Edin | |
| 7,152,657 | B2 | 12/2006 | Bosma | |
| 7,290,609 | B2 | 11/2007 | Wardlaw | |
| 7,478,651 | B2 * | 1/2009 | Simpson | E21B 17/18 138/98 |
| 8,950,438 | B2 * | 2/2015 | Ryan | F16L 55/1645 138/98 |
| 2002/0162596 | A1 | 4/2002 | Simpson | |
| 2002/0056553 | A1 | 5/2002 | Duhon | |
| 2002/0170713 | A1 * | 11/2002 | Haugen | E21B 17/07 166/298 |
| 2003/0132224 | A1 | 7/2003 | Spencer | |
| 2004/0261994 | A1 | 12/2004 | Nguyen | |
| 2005/0109511 | A1 | 5/2005 | Spencer | |
| 2006/0037748 | A1 | 2/2006 | Wardlaw | |
| 2006/0144591 | A1 | 7/2006 | Gonzalez | |
| 2007/0051514 | A1 | 3/2007 | La Rovere | |
| 2007/0137826 | A1 | 6/2007 | Bosma | |
| 2010/0006289 | A1 | 1/2010 | Spencer | |
| 2010/0263876 | A1 | 10/2010 | Frazier | |
| 2011/0132223 | A1 | 6/2011 | Streibich | |
| 2011/0146519 | A1 | 6/2011 | Han | |
| 2011/0174484 | A1 | 7/2011 | Wright | |
| 2011/0214855 | A1 | 9/2011 | Hart | |
| 2012/0199351 | A1 | 8/2012 | Roberston | |
| 2012/0298359 | A1 | 11/2012 | Eden | |
| 2013/0087335 | A1 | 4/2013 | Carraher | |
| 2013/0192833 | A1 | 8/2013 | Gano | |
| 2014/0318782 | A1 | 10/2014 | Bourque | |
| 2015/0211326 | A1 | 7/2015 | Lowry | |
| 2015/0211327 | A1 | 7/2015 | Lowry | |
| 2015/0211328 | A1 | 7/2015 | Lowry | |
| 2015/0345248 | A1 | 12/2015 | Carragher | |
| 2015/0368542 | A1 | 12/2015 | Carragher | |
| 2016/0145962 | A1 | 5/2016 | Carragher | |
| 2016/0319633 | A1 | 11/2016 | Cooper | |
| 2017/0030162 | A1 | 2/2017 | Carragher | |
| 2017/0089168 | A1 | 3/2017 | Carragher | |
| 2017/0226819 | A1 | 8/2017 | Carragher | |
| 2017/0234093 | A1 | 8/2017 | Carragher | |
| 2017/0234100 | A1 | 8/2017 | Carragher | |
| 2017/0306717 | A1 | 10/2017 | Carragher | |
| 2019/0085659 | A1 | 3/2019 | Carragher | |
| 2019/0014355 | A1 | 5/2019 | Carragher | |
| 2019/0186230 | A1 | 6/2019 | Carragher | |

FOREIGN PATENT DOCUMENTS

| | | |
|---|---|---|
| GB | 2016063 | 9/1979 |
| GB | 2 164 886 | 4/1986 |
| WO | WO 2011/151171 | 12/2011 |
| WO | WO 2013/066340 | 5/2013 |
| WO | WO 2013/135583 | 9/2013 |
| WO | WO 2014/096857 | 6/2014 |
| WO | WO 2014/108431 | 7/2014 |

OTHER PUBLICATIONS

International Search report PCT/gb2015/051045.
PCT/GB2015/051045 Opinion.
U.S. Appl. No. 16/095,928, filed Oct. 23, 2018, Carragher.
U.S. Appl. No. 16/589,012, filed Sep. 30, 2019, Carragher.
U.S. Appl. No. 16/616,456, filed Nov. 26, 2019, Carraher.
Feb. 11, 2020, EPO, EPO Opposition Papers EP1574632.5.
Feb. 17, 2016, WIPO, PCT/GB2015/051045, search report and opinion.
Feb. 11, 2020, EPO, List of Art in EPO Oppostion paper EP15774632.5.
Aug. 4, 2012, Norsok, Standard D-010 chapter 9 Plugging, abandonment and suspension.
Mar. 9, 2019, Instructables Workshop, Cast Thermite.
2009, Park, Fabrication of Iron Oxide Thin Films (Florida State Univ).

* cited by examiner

WELL CASING/TUBING DISPOSAL

FIELD OF THE INVENTION

The present invention relates in general to P&A (plugging and abandonment) and work-over operations for underground conduits such as oil/gas wells, and in particular to the removal or disposal of oil well elements such as well casing/tubing.

BACKGROUND OF THE INVENTION

Once an oil/gas well has come to the end of its useful life, the well needs to be safely decommissioned. An important aspect of decommissioning is the plugging and abandonment (P&A) of the well. The plugging of an abandoned well is necessary to seal it off and prevent the escape of hydrocarbons and gases from within the well.

Various methods are known in the art for providing both permanent and removable plugs within abandoned wells. In some situations a plug may be deployed within a well casing that is itself deployed within a bore hole within the ground.

In other situations it is desirable to deploy a plug which extends across the whole cross-section of a bore hole. In these situations it is first necessary to remove the well casing from the region of the bore hole where the plug is to be deployed.

It is known in the art to remove a well casing from within a well bore hole by mechanical means, such as milling or drilling. Such mechanical approaches can be time consuming and, as a result, expensive. They also produce debris in the form of swarf as the casing is broken down, which can interfere with both the milling/drilling itself and any subsequent plugging operation.

In addition, any swarf produced is classed as contaminated material that needs to be disposed of in accordance with strict regulations. This disposal can be very expensive in wells that are located away from the mainland out at sea.

Other suggested approaches involve the use of heat generating mixtures, such as thermite, to melt not only the well casing but also the surrounding materials of the well (e.g. concrete, formation sand). The aim of melting the well casing (and surrounding materials) is to make use of the materials within the well to actually form a plug rather than removing or disposing of the casing.

However, due to the mixture of materials that are melted to form the plug, the effectiveness (e.g. gas tight sealing and resistance to chemical erosion) of these plugs is more difficult to predict than plugs formed from more homogenous compositions (i.e. eutectic alloys or cement).

On other occasions, rather than carrying out plugging and abandonment (P&A) operations on a well, the aim is to carry out work-over operations so as to repair an underground conduit that has become damaged or blocked for whatever reason.

The above mentioned mechanical and heat based approaches are also employed during such operations to clear obstacles from within the well to facilitate subsequent repair work to be carried out.

SUMMARY OF THE INVENTION

The present invention provides methods for use in the removal of well casing and tubing from underground conduits, such as oil/gas wells, to facilitate the subsequent deployment of abandonment plugs within said conduit.

The term 'removal' is used in its broadest sense throughout, in so far as it is the object of the various aspects of the method of the present invention to clear well casing/tubing from a targeted region of well bore hole so as to either expose the surrounding rock formation within which the borehole of the oil/gas well is formed or remove tubing (e.g. production tubing) from within a well casing to clear a path for the deployment of repair tools.

In the case of clearing casing/tubing to expose the surrounding rock formation the clearance formed facilitates the plugging of the entire cross-section of the well bore hole, which allows the formation of a better seal.

In the case of clearing tubing (e.g. such as production tubing) from within a well casing the clearance formed facilitates subsequent repair work to be carried out by removing obstacles to the deployment of the repair tools.

Whether the objective is to form a seal that extends across the entire cross-section of a well bore (i.e. from rock formation to rock formation) or to remove existing tubing from within a well casing to clear a path for the deployment of repair tools, it is envisioned that the methods described hereinafter provide effective solutions.

It is considered important that the various aspects of the method work on the physical properties of the well casing/tubing in such a way that the build-up of debris (e.g. swarf) in the target region. In this way the method of the invention acts to provide a clear work space for the subsequent formation of an effective well abandonment plug, be such a eutectic alloy plug, an ordinary cement plug, or any other known plugging technology.

According to a first aspect of the present invention there is provided a method of clearing well casing or tubing from a target region of an oil/gas well borehole, said method comprising: delivering a chemical agent down the oil/gas well to the target region that is to be cleared; and initiating a chemical reaction between the chemical agent and the well casing or tubing, wherein the chemical reaction consumes one or more chemical components of the material from which the well casing or tubing is made.

By subjecting the material of the well casing/tubing to a chemical reaction that actually consumes the well casing/tubing, rather than simply changing its physical state from a solid to a liquid, it is possible to reduce the amount of debris that accumulates in the well during the well casing/tubing removal process.

Preferably the method may clear the well casing/tubing to expose the rock formation within which the well borehole is formed so that the rock formation can be accessed from within the well casing/tubing.

Further preferably the entire circumference of the well casing in the target region is cleared to expose the surrounding rock formation.

In this way a plug can be formed that extends from across the entire cross-section of the well bore (i.e. from rock formation to rock formation).

Preferably the chemical reaction may involve oxidation of said one or more chemical components of the well casing/tubing, (e.g. the iron present in steel).

Preferably, before the chemical agent is delivered down the well, the well casing/tubing may be provided with a plurality of perforations between the inner and outer walls of the well casing/tubing. It will be appreciated that perforating the well casing/tubing will also weaken the structural integrity of the well casing/tubing, which is beneficial to the object of the present inventions. Advantageously the perforations will be distributed around the entire circumference of the well casing/tubing.

Further preferably an area adjacent to the outer surface of the well casing/tubing may be cleaned out by using pressure washing techniques within the well casing/tubing in the region of the plurality of perforations. In this way it is possible to create space for the heating mixture to accumulate adjacent to the outer surface of the well casing/tubing.

Preferably the delivery of the chemical agent may further include squeezing the agent into the plurality of perforations in the well casing/tubing so that the agent is provided on both sides of the well casing/tubing as well as within the wall of the well casing/tubing itself.

Preferably the chemical agent may be provided as a gel, a paste, a pseudo liquid or a solid. The gel, paste and pseudo liquid forms being particularly suitable for squeezing in to the perforations formed in the well casing/tubing.

Alternatively the chemical agent may comprise a block of thermite or thermate, wherein at least a portion of the surface of the block is coated with an oxidising chemical.

In a second aspect of the present invention is provided a method of clearing well casing or tubing from a target region of an oil/gas well borehole, said method comprising: subjecting the target region to a rapid temperature change so as to alter the physical properties of the well casing/tubing in the target region and thereby embrittle, soften or otherwise weaken the well casing/tubing without melting it; and applying one or more physical or environmental stresses to the target region to shatter or otherwise clear the weakened well casing/tubing.

By rapidly changing the temperature of the well casing/tubing it is possible alter the physical properties of the metals from which the well casing/tubing is formed making the well casing/tubing in the target region more brittle and thus easy to shatter upon the application of stress to the weakened (i.e. embrittled) region of well casing/tubing.

It is appreciated in cases where the well casing/tubing is formed from metal alloys that have low carbon content the well casing/tubing is more inclined to soften rather than embrittle when subjected to the rapid temperature changes.

By softening the well casing/tubing in this way it makes them easier and quicker to mill/drill out using standard mechanical means. The softening also leads to the production of much smaller bits of swarf during the milling/drilling process. The build-up of swarf during the milling/drilling process can be problematic and thus any reduction in the size of swarf being produced is considered desirable.

Preferably the method may involve clearing the well casing/tubing to expose the rock formation within which the well borehole is formed so that the rock formation can be accessed from within the well casing/tubing.

Preferably the temperature may be rapidly cooled before said physical or environmental stress is applied. This approach is particularly applicable when the ambient temperature of the down hole environment is already high enough to ensure a steep temperature gradient when the rapid cooling is applied.

Advantageously, the temperature in the target region may first be increased and then rapidly cooled. This ensures the creation of a steep gradient to the temperature change, which improves the embrittlement levels achieved. Preferably the temperature in the target region is not increased to a level that is sufficient to melt the well casing/tubing.

Preferably the temperature changes in the target region of the well casing/tubing may be facilitated by delivering chemical heating and/or cooling means to the target region.

Preferably the source of the one or more physical or environmental stresses may be selected from the group containing: an incendiary device; a sonic device; and a mechanical device, such as milling/drilling means. It is envisaged that the identified devices may be used on their own or in combination, as appropriate.

The level of stress that is required to break the well casing/tubing is greatly reduced by the preceding embrittlement of the well casing/tubing caused by the chemical heating and sudden quenching. As a result more compact and easily delivered devices can be used to shatter the well casing/tubing.

Preferably, before the chemical heating and/or cooling means are delivered down the well, the well casing/tubing may be provided with a plurality of perforations between the inner and outer walls of the well casing/tubing. Advantageously the perforations will be distributed around the entire circumference of the well casing/tubing.

Further preferably an area adjacent to the outer surface of the well casing/tubing may be cleaned out by using pressure washing techniques within the well casing/tubing in the region of the plurality of perforations. In this way it is possible to create space for the heating/cooling means to accumulate adjacent to the outer surface of the well casing/tubing.

Preferably the delivery of the chemical heating and/or cooling means may further include squeezing the means into the plurality of perforations in the well casing/tubing so that the means is provided on both sides of the well casing/tubing as well as within the wall of the well casing/tubing itself.

Preferably the method may further comprise providing an insulating material in the cleaned out area adjacent the outer surface of the casing to maximise the impact of the temperature changes produced in the well casing/tubing.

Additionally or alternatively the method may further comprise providing a material in the cleaned out area adjacent the outer surface of the well casing/tubing to draw the heat generated within the well casing/tubing through the walls of the well casing/tubing. One group of suitable heat drawing materials are commercially available from Dow Corning Corporation under the trademark DOWTHERM™.

Preferably the chemical heating means may comprise thermite or thermate. The thermite or thermate may be deployed as part of a mixture of other elements, such as oxidising chemicals.

Preferably the chemical heating means may be provided as a gel, paste, a pseudo liquid or a solid. The gel, paste and pseudo liquid forms being particularly suitable for squeezing in to the perforations formed in the well casing/tubing.

Advantageously the chemical heating means may be provided as at least one solid block. Further preferable the solid block may have a central hole or conduit to allow access or egress through the solid block when such is within the well casing or tubing.

In this way gases generated within the target region can escape. The conduit also provides a way of delivering chemical cooling means to the target region rapidly.

In a third aspect of the present invention there is provided a method of clearing well casing or tubing from a target region of an oil/gas well borehole, said method comprising: producing a plurality of perforations in the target region of the well casing/tubing that is to be cleared; delivering a chemical heating mixture to region of the perforated well casing/tubing; and initiating the chemical heating mixture and melting the well casing/tubing in the region to be cleared.

By perforating the well casing before delivering the chemical heating mixture it is possible to deliver the mixture to both sides of the well casing/tubing and thereby achieve a more uniform heating of the well casing/tubing.

Preferably the method may involve clearing the well casing/tubing to expose the rock formation within which the well borehole is formed so that the rock formation can be accessed from within the well casing/tubing.

Advantageously the perforations will be distributed around the entire circumference of the well casing/tubing.

Preferably an area adjacent to the outer surface of the well casing/tubing may be cleaned out by using pressure washing techniques within the well casing/tubing in the region of the plurality of perforations. In this way it is possible to create space for the heating mixture to accumulate adjacent to the outer surface of the well casing/tubing.

Preferably the delivery of the chemical heating mixture may further include squeezing the mixture into the plurality of perforations in the well casing/tubing so that the mixture is provided on both sides of the well casing/tubing as well as within the wall of the well casing/tubing itself.

By using the perforations to deliver the chemical heating mixture to either side of the well casing/tubing and also within the wall of the well casing/tubing it is possible to achieve a more uniform melt of the well casing/tubing around its entire circumference.

Preferably the method may further comprise providing an insulating material in the cleaned out area adjacent the outer surface of the well casing/tubing to maximise the impact of the temperature changes produced in the well casing/tubing.

Additionally or alternatively the method of this aspect may further comprise providing a material in the cleaned out area adjacent the outer surface of the well casing/tubing to draw the heat generated within the well casing/tubing through the walls of the well casing One group of suitable heat drawing materials are commercially available from Dow Corning Corporation under the trademark DOW-THERM™.

Suitable chemical heating mixtures include mixtures comprising thermite and thermate.

Preferably the chemical heating mixture may be provided as a gel, paste, a pseudo liquid or a solid. The gel, paste and pseudo liquid forms being particularly suitable for squeezing in to the perforations formed in the well casing/tubing.

In some applications it would be beneficial for the chemical heating mixture to be provided in the form of at least one solid block. Further preferably the solid block(s) may have a central hole to allow the escape of any steam/gas produced by the heating of down hole fluids during the reaction.

Advantageously the central hole also facilitates control of the burn and keeps it close to the well casing/tubing. It is envisaged that by providing the access/escape means in the middle of the block is better than simply reducing the diameter of the block so that there is a gap between the well casing/tubing and the block, because the block is kept closer to the well casing/tubing and thus is more effective.

It is appreciated that in some operations additional benefit may be achieved by using a combination of chemical heating mixtures in different states. For instance, a paste or gel of heating material could first be applied (e.g. squeezed) through perforations formed in a well casing/tubing to facilitate the heating of the outer surface of the well casing/tubing. Then a solid block, perhaps with the central vents, could be deployed within the well casing/tubing to provide the heat within the well casing/tubing.

It will be appreciated that the use of the various methods of the present invention will facilitate the separation of the well casing/tubing into two sections (i.e. the portion above the consumed/shattered/melted region and the portion below it.

In the case were the well casing is cleared the gap created between the two sections of the well casing exposes the surrounding rock formation and provides a region in which a plug can be formed across the entire cross-section of the well bore hole (i.e. from the rock formation on one side of the borehole to the rock formation on the other side of the borehole).

In the case were an inner tubing is cleared the removal of the tubing from within the well casing facilitates the deployment of repair tools to carry out work-over operations.

BRIEF DESCRIPTION OF THE DRAWINGS

The various aspects of the present invention will now be described with reference to the drawings, wherein.

DETAILED DESCRIPTION OF A PREFERRED EMBODIMENT

Figures 1A, 1B, 1C, 1D, 1E:
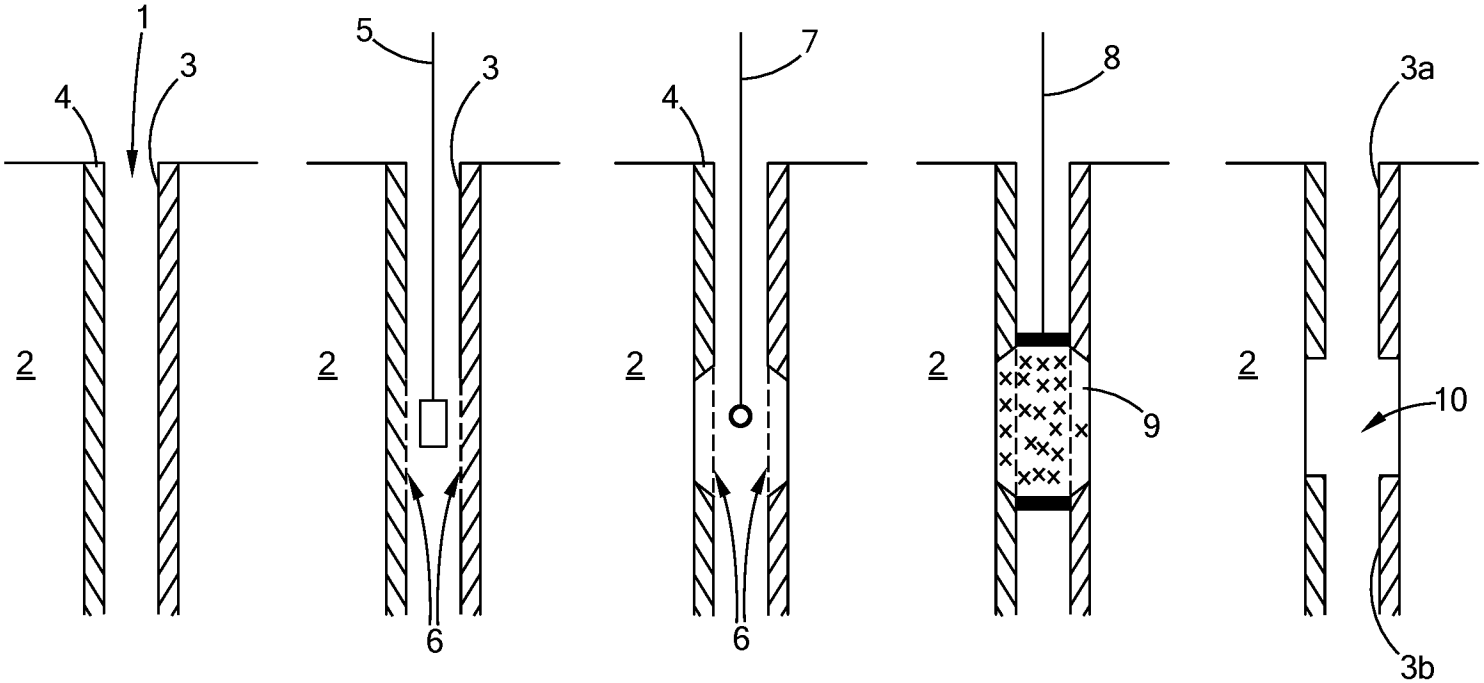
FIG. 1*a* shows a well casing in situ within a well bore hole.
FIG. 1*b* shows the well casing perforation stage of the method of the present invention.
FIG. 1*c* shows the jet washing stage of the method of the present invention.
FIG. 1*d* shows the step of the delivery of chemical heating mixture into and around the well casing.
FIG. 1*e* shows the separate portions of the well casing following the reaction of the chemical heating mixture within the well bore hole.

So that the general concept of the present invention might be better understood an exemplary process of the well casing/tubing disposal method of the present invention will be described with reference to FIGS. 1*a*-1*e*.

The skilled person will appreciate from the following description, that certain steps shown in the drawings may be omitted without departing from the general inventive concept. Further, the skilled person will also appreciate that additional steps to those shown may also be used to achieve additional benefits.

Turning now to FIGS. 1*a*, 1*b*, 1*c*, 1*d* and 1*e*, which show in order the steps involved in removing/disposing of a portion of a well casing/tubing so as to create an exposed region capable of receiving a well plug that can be used to form a plug across the entire cross-section of a well bore hole (i.e. from the rock formation on one side of the borehole to the rock formation on the other side of the borehole).

It will be appreciated that although FIGS. 1*a*, 1*b*, 1*c*, 1*d* and 1*e* depict the application of the clearance method of the present invention to remove a well casing and expose the surrounding rock formation the described method can also be employed to remove tubing other than well casing.

One example of alternative tubing that can be removed using the described methods is production tubing. In cases where only the production tubing is to be removed the surrounding rock formation does not necessarily need to be exposed.

FIG. 1*a* shows a well 1 provided in a rock formation 2. The well comprises a well casing or other form of tubing 3 formed within a bore hole in the rock formation 2. In the region between the rock formation and the casing/tubing 3 is provided an annulus 4, which may be filled with cement.

FIG. 1*b* shows the first stage of the casing/tubing removal method, wherein a plurality of perforations 6 are formed in the casing/tubing 3 by way of a perforating device 5 that is deliverable down the well 1 using existing delivery means.

Preferably the perforating device 5 is capable of delivering a controlled explosion within the region of the casing that is to be perforated. The device 5 is preferably capable of perforating the casing in a 360° target region so that perforations are provided around the entire circumference of the casing.

FIG. 1*c* shows the next stage in the method of the present invention, wherein a pressure washing or water jet washing device 7 is delivered down the well 1 to the region of the casing in which the perforations 6 were formed. Once again existing delivery means can be utilised to deliver the washing device 7 to the target region within the well (e.g. cable wire line).

Once the pressure washing or water jet washing device 7 is in position the device can be focused towards the perforations 6 in the casing. In this way the washing device 7 can be used to clean out or erode the annulus material 4 adjacent to the perforated region of the well casing/tubing.

The step of the clearing away a region of annulus material 4 from area surrounding the perforated casing is considered to be advantageous because it provides additional space into which the active chemical agent 9 (see FIG. 1*d*) can be received. In this way the level of heating applied from the outer surface of the casing is enhanced.

It is envisaged that as an alternative, insulating material or a heat drawing material (such as DOWTHERM™) may be received in the space formed by clearing away the annulus material with pressure jet washing.

However it is envisaged that, although beneficial, the step of washing out the region of annulus material 4 may not be essential in all circumstances; for example when the preceding perforating step itself causes the formation of space in the annulus material 4 surrounding the casing 3, which further helps to expose the surrounding rock formation.

FIG. 1*d* shows the step of deploying the active chemical agent 9 to the perforated region of the well casing/tubing 3. The active chemical agent 9 is delivered to the target region using a delivery tool 8, which is connectable to existing delivery means; such as cable wireline.

Depending on which method of the various aspects of the present invention is being employed the active chemical agent may be selected from:

- A chemical agent this is capable of reacting with, and thereby consuming, one or more chemical components of the well casing;
- A chemical heating and/or cooling means capable of rapidly changing the temperature within the target region of the well casing;
- A chemical heating mixture.

The delivery tool 8 is capable of carrying the active chemical agent 9 down the well to the target region. Once in position the delivery tool 8 can then be operated to force the active chemical agent 9 through the perforations 6 in the casing and in to the cleared region in the annulus material 4.

In this way both the inside and the outside of the casing/tubing 3 are placed in contact with the active chemical agent 9 thereby allowing a more uniform treatment of the casing/tubing 3 to be achieved.

It is envisioned that in the case of the chemical heating mixture the active chemical agent 9 might advantageously be provided in the form of paste or gel of a material such as thermite or thermate so that it can more readily be squeezed through the casing perforations 6.

Once the active chemical agent 9 is suitably distributed in and around the casing/tubing 3 the chemical reaction can be initiated. Depending on the nature of the active chemical agent being used this may be done remotely or by way of timing device.

As explained above, depending on the type of active chemical agent 9 used the method of the present invention might facilitate the removal/disposal of the well casing by way of: consuming one or more chemical components of the well casing; changing the physical properties of the well casing so as to embrittle it followed by targeted physical or environmental stressing; and melting the well casing in the target region.

Consumption of the Well Casing

In the first aspect of the method of the present invention the well casing/tubing is broken down by using chemicals that react with materials from which the well casing is formed.

In its broadest sense any chemicals that are capable of reacting with the well casing in such a way that produces material which is readily cleared from the target region (e.g. in the form of gases or powders) to expose the rock formation are considered applicable.

One appropriate chemical reaction is considered to be oxidation, wherein the casing is effectively consumed or burnt (i.e. like a fuel) rather than melted (i.e. turned from a solid state to a liquid state).

In situations where the well casing/tubing has a steel component it is envisaged that a process of Iron oxidisation might be employed.

Embrittlement or Softening and Subsequent Removal of the Well Casing

In a second aspect of the method of the present invention the well casing/tubing is again subjected to high temperatures; whether as a consequence of the high temperatures already present in the down-hole environment or as a result of chemical heating means delivered to the target region.

However unlike the melting approach adopted in the third aspect of the present invention the well casing is subjected to a rapid cooling before melting occurs.

It is envisaged that the rapid cooling of the well casing (possible using cooling means such as liquid nitrogen or cold water) results in a change the structural orientation of the metal from which the casing is formed. This can make the casing more brittle and susceptible to shattering. Although in the case of well casings/tubings that are formed from alloys that have low carbon content the casing/tubing has a tendency to soften rather than embrittle. In both cases the rapid temperature changes transform the well casing/tubing and make it easier to clear/remove.

Once the casing has been embrittled the target region can be subjected to mechanical stresses, such as physical attack or sonic attack. Thus the weakened casing is removed by shattering the casing in the targeted region.

Alternatively, once the casing has been softened the target region can be milled/drilled out using standard milling/drilling equipment. The softened casing is much easier, and thus quicker, to remove. An added benefit is achieve by the softening of the well casing/tubing, in that the sward formed during the milling/drilling process is created in smaller more manageable pieces.

It is envisioned that providing the perforations in the well casing enables the cooling medium to access both the inside and the outside of the well casing, thus providing uniform cooling.

Melting of the Well Casing

In a third aspect of the method of the present invention the well casing/tubing is subjected to high temperatures which melt the target region of the casing. It is envisaged that thermite and thermate mixes would be particularly suitable to achieve the high melting temperatures of over 1800° C. that are required.

Unlike in the first and second aspect of the present invention, where it is considered merely an beneficial additional step, the step of perforating the well casing/tubing is considered essential to this aspect of the invention as it allows the heat to be applied not only from within the casing but also from outside—thereby maximising the destruction of the targeted casing region by melting.

In each of the above approaches a region of the casing/tubing 3 is destroyed and a cleared region 10 is created within the well bore hole. FIG. 1*e* shows the well hole 1 following one of the above mentioned casing removal stages (i.e. melting; embrittlement/shattering; burning).

Once created within the well hole the cleared region 10, which extends to the rock formation within which the borehole is formed, facilitates a well abandonment plug to be deployed therein. The removal of the casing/tubing means that a plug can be formed which extends across the entire cross-section of the well hole (i.e. from the rock formation on one side of the borehole to the rock formation on the other side of the borehole), thus providing a substantial and effective seal.

It is envisioned that the cleared region 10 provided using the method of the claimed invention would be suitable for both cement plugs and plugs formed using eutectic alloys.

The invention claimed is:

1. A method of clearing well casing or tubing from a target region of an oil/gas well borehole, said method comprising:

subjecting the target region to a rapid temperature change so as to alter a physical property of the well casing/tubing in the target region and thereby embrittle, soften or otherwise weaken the well casing/tubing without melting it;

applying one or more physical or environmental stresses to the target region to clear the weakened well casing/tubing; and clearing well casing or tubing from a target region of an oil/gas well borehole to expose the rock formation within which the well borehole is formed so that the rock formation can be accessed from within the well casing/tubing.

2. The method of claim 1, wherein the temperature is rapidly cooled before said physical or environmental stress is applied.

3. The method of claim 1, wherein the temperature is first increased to a temperature not exceeding the melting point of the well casing/tubing and then rapidly cooled; and wherein the one or more physical or environmental stresses are selected from the group consisting of physical attack, sonic attack, milling, and drilling.

4. The method of claim 1, wherein the temperature changes are facilitated by delivering chemical heating and/or cooling means to the target region; and, wherein the one or more physical or environmental stresses breaks the weakened well casing/tubing.

5. The methods of any of claims 2, 3 or 4, wherein the source of the one or more physical or environmental stresses is selected from the group containing: an incendiary device; a sonic device; and a milling or drilling device.

6. The method of claim 4, further comprising: producing a plurality of perforations in the well casing/tubing before delivering the chemical heating or cooling means down the oil/gas well.

7. The method of claim 6, wherein an area adjacent to the outer surface of the well casing/tubing is cleaned out using pressure washing techniques within the well casing/tubing in the region of the perforations before the delivery step.

8. The method of claim 7, further comprising providing an insulating material in the cleaned out area adjacent the outer surface of the well casing/tubing to maximise the impact of the temperature changes produced in the well casing/tubing.

9. The method of claim 7, further comprising providing a material in the cleaned out area adjacent the outer surface of the well casing/tubing to draw the heat generated within the well casing/tubing through the walls of the well casing/tubing.

10. The method of claim 6, wherein the delivery of the chemical heating or cooling means mixture further includes squeezing the chemical heating or cooling means into the perforations in the well casing/tubing so that said means are provided on both sides of the well casing/tubing as well as within the wall of the well casing/tubing itself.

11. The methods of any of claims 1, 2, 3, or 4, wherein the temperature change is facilitated by delivering chemical heating from a chemical heating means and wherein the chemical heating means comprises thermite or thermate.

12. The methods of any of claims 1, 2 or 3 wherein the temperature change is facilitated by delivering chemical heating from a chemical heating means and wherein the chemical heating means is provided as a gel, a paste, a pseudo liquid or a solid.

13. The method of claim 1, wherein the rapid temperature change is facilitated by delivering chemical heating from a chemical heating means comprising a solid form chemical heating means and is provided as at least one solid block.

14. The method of claim 13, wherein said solid block has a central hole or conduit to allow access or egress through the solid block when such is within the well casing or tubing.

15. A method of plugging an oil/gas well bore, said method comprising:

using the method of claim 1 to clear away a target region of well casing or tubing so as to expose the rock formation that surrounds the well bore hole; and forming a plug within the well bore, wherein said plug extends across the entire cross-section of the well bore.

16. The method of claim 15, wherein the plug formed within the well bore is a eutectic alloy based plug.

17. A method of repairing an oil/gas well bore, said method comprising:

using the method of claim 1 to clear away a target region of well casing or tubing; and deploying a repair tool within the well bore to affect a repair of the well casing.

* * * * *